US010974266B2

(12) United States Patent
Ramsuer et al.

(10) Patent No.: US 10,974,266 B2
(45) Date of Patent: Apr. 13, 2021

(54) ATOMIZER DEVICES, BOTTLES, AND METHODS OF USING THE SAME

(71) Applicant: Silgan Dispensing Systems Corporation, Grandview, MO (US)

(72) Inventors: Brandon L. Ramsuer, Henrico, VA (US); Kelly A. Harrigan, Richmond, VA (US); Brian van Houten, Kansas City, MO (US); William L. Driskell, Lee's Summit, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 29 days.

(21) Appl. No.: 16/348,144

(22) PCT Filed: Nov. 3, 2017

(86) PCT No.: PCT/US2017/059911
§ 371 (c)(1),
(2) Date: May 7, 2019

(87) PCT Pub. No.: WO2018/128686
PCT Pub. Date: Jul. 12, 2018

(65) Prior Publication Data

US 2019/0366367 A1 Dec. 5, 2019

Related U.S. Application Data

(60) Provisional application No. 62/422,868, filed on Nov. 16, 2016.

(51) Int. Cl.
*B05B 11/04* (2006.01)
*B05B 15/30* (2018.01)
*B05B 11/00* (2006.01)
*B65D 47/20* (2006.01)

(52) U.S. Cl.
CPC ..... *B05B 11/043* (2013.01); *B05B 11/0008* (2013.01); *B05B 11/0027* (2013.01); *B05B 11/3011* (2013.01); *B05B 11/3057* (2013.01); *B05B 15/30* (2018.02); *B65D 47/2068* (2013.01)

(58) Field of Classification Search
CPC ..... B05B 11/043; B05B 11/0008; B05B 11/0027; B05B 11/3057; B05B 11/3011; B05B 15/30; B65D 47/2068
USPC .... 239/327, 328, 333, 419, 419.5, 433, 434, 239/356, 1, 8
See application file for complete search history.

(56) References Cited

U.S. PATENT DOCUMENTS

D203,950 S 3/1966 Swayze
D208,826 S 10/1967 Hutton et al.
3,572,590 A * 3/1971 Malone ..... A61M 11/02 239/327
3,575,590 A 3/1971 Malone
3,648,903 A * 3/1972 Marchant ..... B05B 11/047 222/212

(Continued)

*Primary Examiner* — Steven J Ganey
(74) *Attorney, Agent, or Firm* — Barlow, Josephs & Holmes, Ltd.

(57) ABSTRACT

Bottles and atomizer configurations provide dispensers capable of atomizing a fluid or liquid contained in the bottle, wherein the bottles may include shapes and features to facilitate evacuation of the bottles and the atomizers provide improved features for storing and dispersing product from the bottles.

5 Claims, 11 Drawing Sheets

(56) References Cited

U.S. PATENT DOCUMENTS 4,186,882 A * 2/1980 Szczepanski ..... B05B 11/0059 222/212
D254,838 S 4/1980 Agnone et al.
D260,236 S 8/1981 Anderson et al.
4,401,270 A * 8/1983 McKinney ..... B05B 11/043 222/212
4,415,122 A * 11/1983 Laauwe ..... B05B 11/043 239/327
D288,529 S 3/1987 Parad
D299,428 S 1/1989 Wilfond
D308,330 S 6/1990 Teece
D310,960 S 10/1990 Verebelyi
5,083,683 A 1/1992 Knickerbocker
5,219,098 A 6/1993 Tada
D357,630 S 4/1995 Byrne et al.
D399,431 S 10/1998 de Baschmakoff
D418,404 S 1/2000 Irwin et al.
D438,786 S 3/2001 Ghali
D457,439 S 5/2002 Meeker et al.
D460,917 S 7/2002 Trabal
D481,951 S 11/2003 Scott, III
D501,142 S 1/2005 Pattison
D536,975 S 2/2007 Smith et al.
D543,116 S 5/2007 Heisner
D547,652 S 7/2007 Kerman et al.
D590,712 S 4/2009 Sweeton
D592,069 S 5/2009 Kruparova
D595,575 S 7/2009 Cichy
D600,126 S 9/2009 Lepoitevin
D606,979 S 12/2009 Nelson et al.
D611,824 S 3/2010 Akkermans
D614,488 S 4/2010 Kallenbach et al.
D631,347 S 1/2011 Rudolph et al.
D644,929 S 9/2011 White et al.
D661,583 S 6/2012 Santarelli et al.
D663,625 S 7/2012 Warneke et al.
D672,247 S 12/2012 Kreider et al.
8,336,790 B2 * 12/2012 Kolins ..... A61L 9/12 239/327
D680,436 S 4/2013 Sanchez
D695,612 S 12/2013 De Araujo et al.
D696,127 S 12/2013 Juna
D697,810 S 1/2014 Juna
D702,551 S 4/2014 Wisniewski et al.
D722,502 S 2/2015 Landrum et al.
D727,093 S 4/2015 Lapsker
D735,043 S 7/2015 Herbst
D741,188 S 10/2015 Juna
D751,904 S 3/2016 Landrum et al.
D753,497 S 4/2016 Dietvorst et al.
D787,326 S 5/2017 Hanson et al.
2002/0030069 A1 3/2002 Auer
2002/0113090 A1 8/2002 Gross et al.
2004/0182861 A1 9/2004 Miranda
2004/0251258 A1 12/2004 Akiyama et al.
2009/0101646 A1 4/2009 Paul et al.
2009/0314856 A1 12/2009 Romanov et al.
2010/0107341 A1 5/2010 Floyd et al.
2011/0067576 A1 3/2011 White et al.
2012/0048959 A1 3/2012 Mass et al.
2012/0305602 A1 12/2012 Kneer et al.

* cited by examiner

ATOMIZER DEVICES, BOTTLES, AND METHODS OF USING THE SAME

BACKGROUND OF THE INVENTION

Field of the Invention: Embodiments of the invention relate to dispensing systems and more particularly to atomizers or aspirator-type dispensers and bottles configured to work with such atomizers or aspirator-type dispensers.

State of the Art: There are many different types of dispensers which may be used to atomize a fluid being dispensed therefrom. Some atomize a fluid utilizing an orifice having specific spin mechanic features designed to cause atomization. Others atomize a fluid by forcing the fluid to collide with a gas stream, such as air. For example, such dispensers are often referred to as aspirators and may include designs such as those illustrated in U.S. Pat. No. 6,250,568, which is incorporated herein in its entirety by reference. Such devices may be used to atomize a fluid stream being dispensed therefrom. Such devices are often attached to a bottle filled with a fluid. As the bottle is squeezed, air and fluid from within the bottle are forced through the atomization device to produce an atomized spray of fluid.

While aspirators or other atomization devices exist, there are known issues with such devices. For instance, such devices often have one or more fluid or product outlets along with one or more air or gas outlets configured to allow the air and fluid to mix. When such devices are attached to a bottle and the bottle tips or falls on its side, fluid often leaks from the devices through both fluid and air outlets. Such leaking is undesirable. In addition, such devices may not produce complete atomization of the fluid, resulting in larger droplets or even streams of product fluid being dispensed instead of an atomized fog or cloud. Furthermore, the bottles used with such dispensers are often designed with a large bulb or reservoir at the top of the bottle to contain liquid during use and to provide an air pocket for initial use of the dispensing product. Such bottles do not allow complete evacuation of the fluid from the bottle or make it very difficult to do so.

Thus, there is a need for improved dispensing systems utilizing simple atomization features and having improved bottle and dispensing combinations to provide users with a better dispensing experience.

BRIEF SUMMARY OF THE INVENTION

According to certain embodiments of the invention, a dispenser includes a bottle and an aspirator or atomizer. In some embodiments of the invention, a bottle may include a hand ledge defining a natural position for a user to place their hand. A hand ledge may be positioned below the upper third of the bottle. In other embodiments, a hand ledge may be positioned within the middle third of the bottle.

In other embodiments of the invention, a bottle may include a bottle curve adjacent to or above a hand ledge. The bottle curve may have rounded corners. In some embodiments of the invention, a cross-sectional slice of the bottle curve or hand ledge may be of substantially oval shape.

In still other embodiments of the invention, an atomizer may include features to allow the atomizer to be turned on or off. In some embodiments, an atomizer may be turned on and off by closure of a cap. In other embodiments, an atomizer may be turned on and off by rotation of a nozzle relative to a closure associated therewith. In still other embodiments, an atomizer may be turned on and off by a push/pull motion of a nozzle relative to a closure associated therewith.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 4:
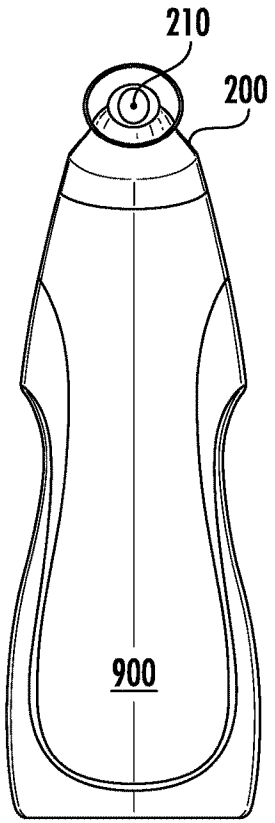
FIG. 4 illustrates a front view of a dispenser according to various embodiments of the invention.
Figure 3:
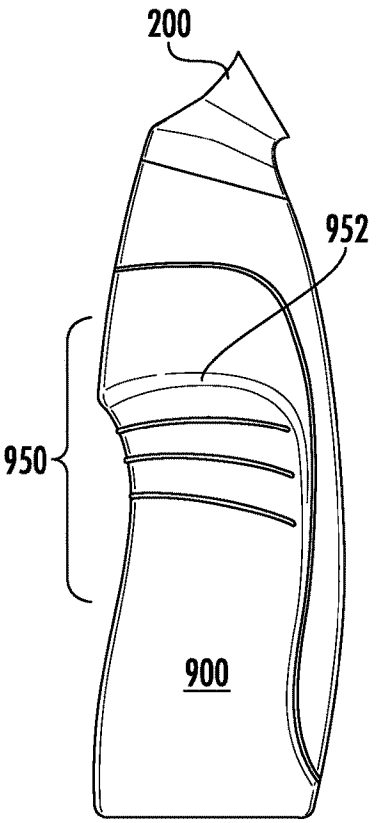
FIG. 3 illustrates a side view of a dispenser according to various embodiments of the invention.
Figure 2:
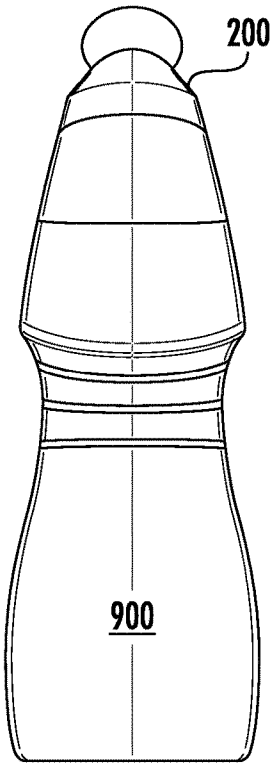
FIG. 2 illustrates a rear view of a dispenser according to various embodiments of the invention.
Figure 1:
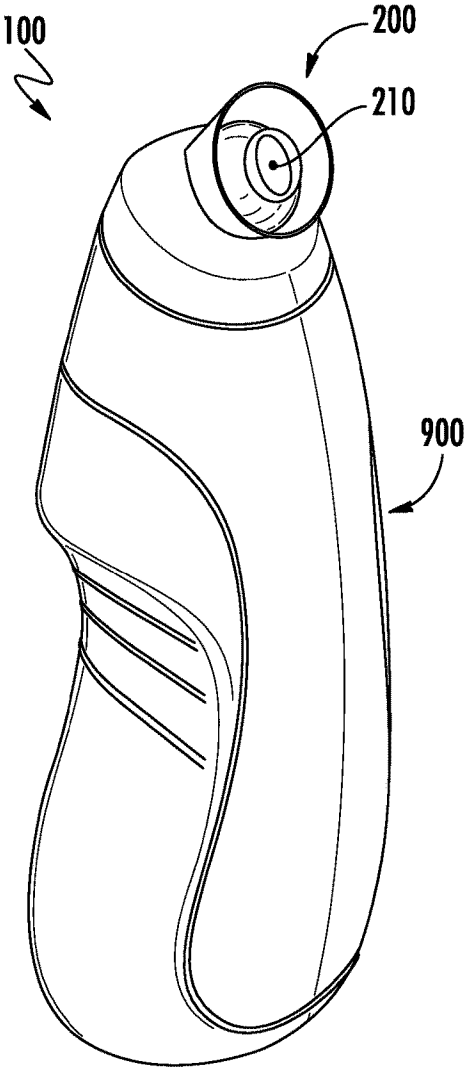
FIG. 1 illustrates a perspective view of a dispenser according to various embodiments of the invention.

According to certain embodiments of the invention, a dispenser 100 may include an atomizer 200 attached to a bottle 900. For example, according to some embodiments of the invention, an atomizer 200 may be attached to a bottle as illustrated in FIGS. 1 through 4.

An atomizer 200 according to certain embodiments of the invention may include one or more molded components configured to attach to a bottle 900. Attachment of the atomizer 200 to the bottle 900 may be made in any one of many different ways. For instance, a bayonet-type closure as known may be used. In other embodiments, a screw-type closure may be used wherein threads on an interior surface of the atomizer 200 may mate with threads on an exterior surface of the bottle 900 to allow the atomizer 200 to be attached to the bottle 900. In still other embodiments, other connection systems may be used, including but not limited to, ultrasonic welding, snap-fit closure features, and plug-seal closure or connections. In addition, child-resistant or tamper evident features may be incorporated into the closure design to prevent or restrict removal of an atomizer 200 from a bottle 900 once the atomizer 200 is attached thereto. For example, ratchet features on the atomizer 200 and bottle 900 may work together to retain the atomizer 200 on the bottle 900. Various embodiments of the invention are not limited by how such features are incorporated with the dispensers 100 of the current invention.

In some embodiments of the invention, an atomizer 200 may include a flip-top aspirator such as those illustrated and described in U.S. Pat. No. 6,250,568. In other embodiments, an atomizer 200 according to various embodiments of the invention may incorporate other features.

Figure 5:
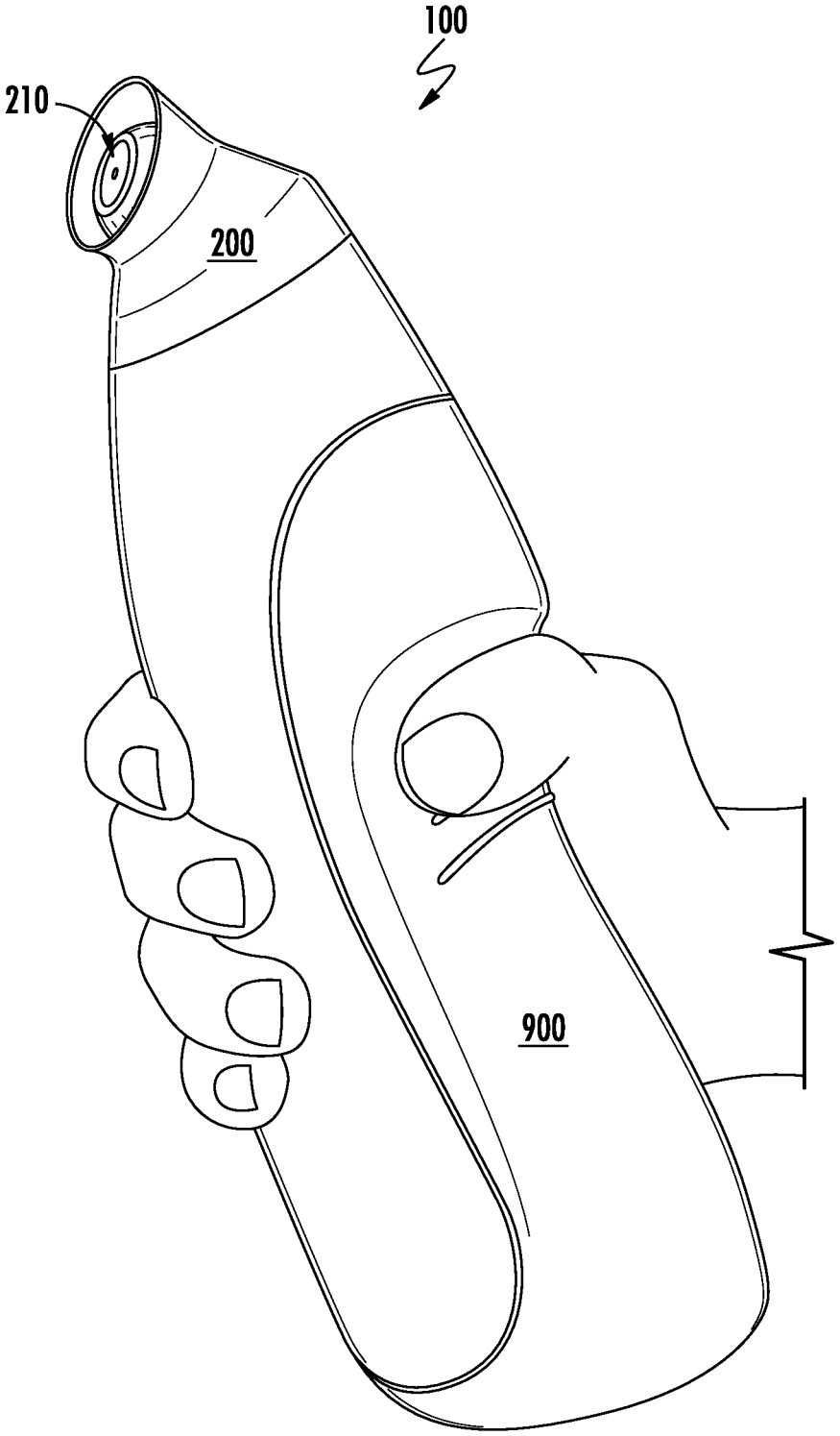
FIG. 5 illustrates a perspective view of a dispenser in use according to various embodiments of the invention.

An atomizer 200 according to certain embodiments of the invention may be part of a dispenser 100 as illustrated in FIGS. 1 through 5. As illustrated, the atomizer 200 may include an orifice opening 210 through which air and a fluid or liquid product from an interior of bottle 900 are forced to generate an atomized cloud of fluid. The orifice opening 210 may be directed at an angle as illustrated to provide a directional spray or cloud of product out of the orifice opening 210 when a user squeezes the bottle 900. For instance, FIG. 5 illustrates a dispenser 100 as illustrated in FIGS. 1 through 4 in use. As a user squeezes the bottle 900, a fog of product is produced and delivered through the orifice opening 210 of the dispenser 100.

Figure 6:
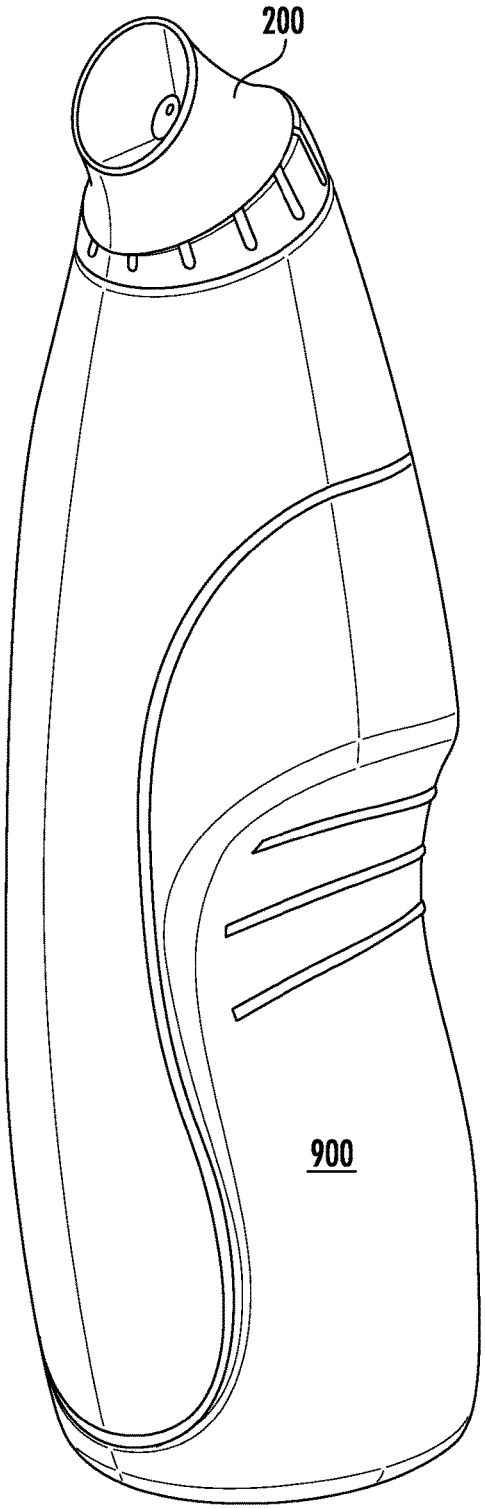
FIG. 6 illustrates a perspective view of a dispenser according to various embodiments of the invention.
Figure 7:
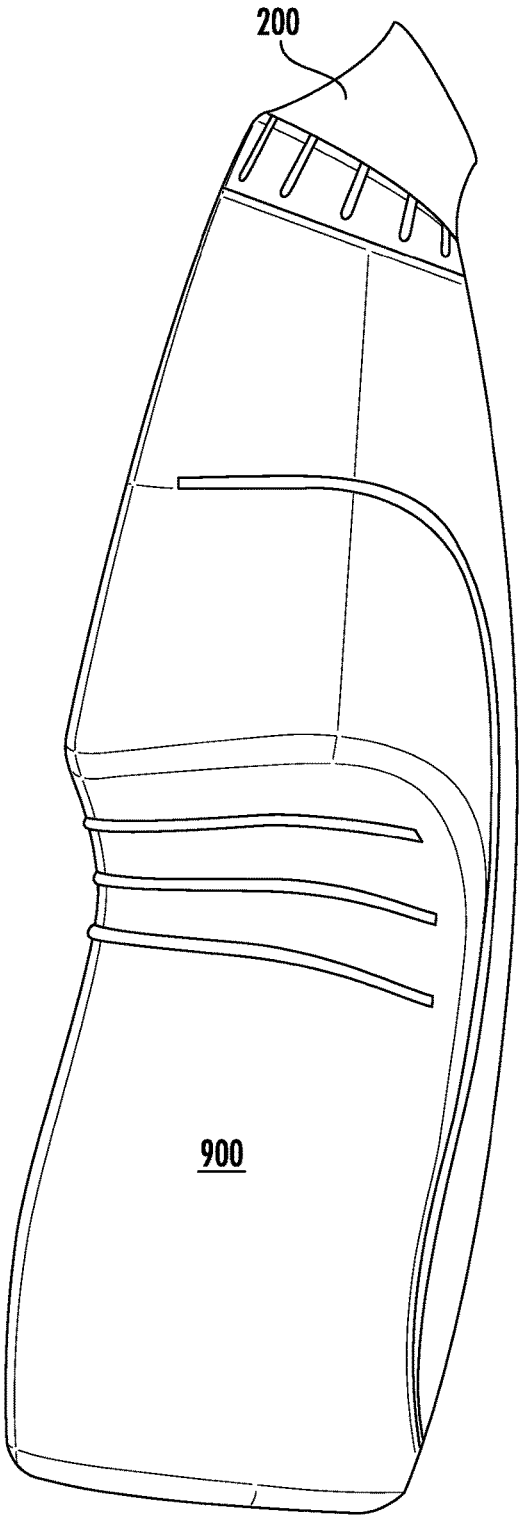
FIG. 7 illustrates an alternate perspective view of the dispenser of FIG. 6.

According to various embodiments of the invention, an atomizer 200 may include different shapes and aesthetic designs. For instance, the aesthetic design illustrated in FIGS. 1 through 5 are unique. A second aesthetic design is illustrated in FIGS. 6 and 7. The atomizer 200 illustrated in FIGS. 6 and 7 may have fewer undercuts or sharp angles, thereby facilitating a simpler molding process for making the atomizer 200—or the exterior component of the atomizer 200—which may result in cost reductions associated with producing such atomizers 200.

As illustrated in FIGS. 6 and 7, the orifice opening 210 is directed upwards to direct a spray or fog emitted from the atomizer 200 to project in the general direction that the orifice opening 200 is directed.

Figure 8:
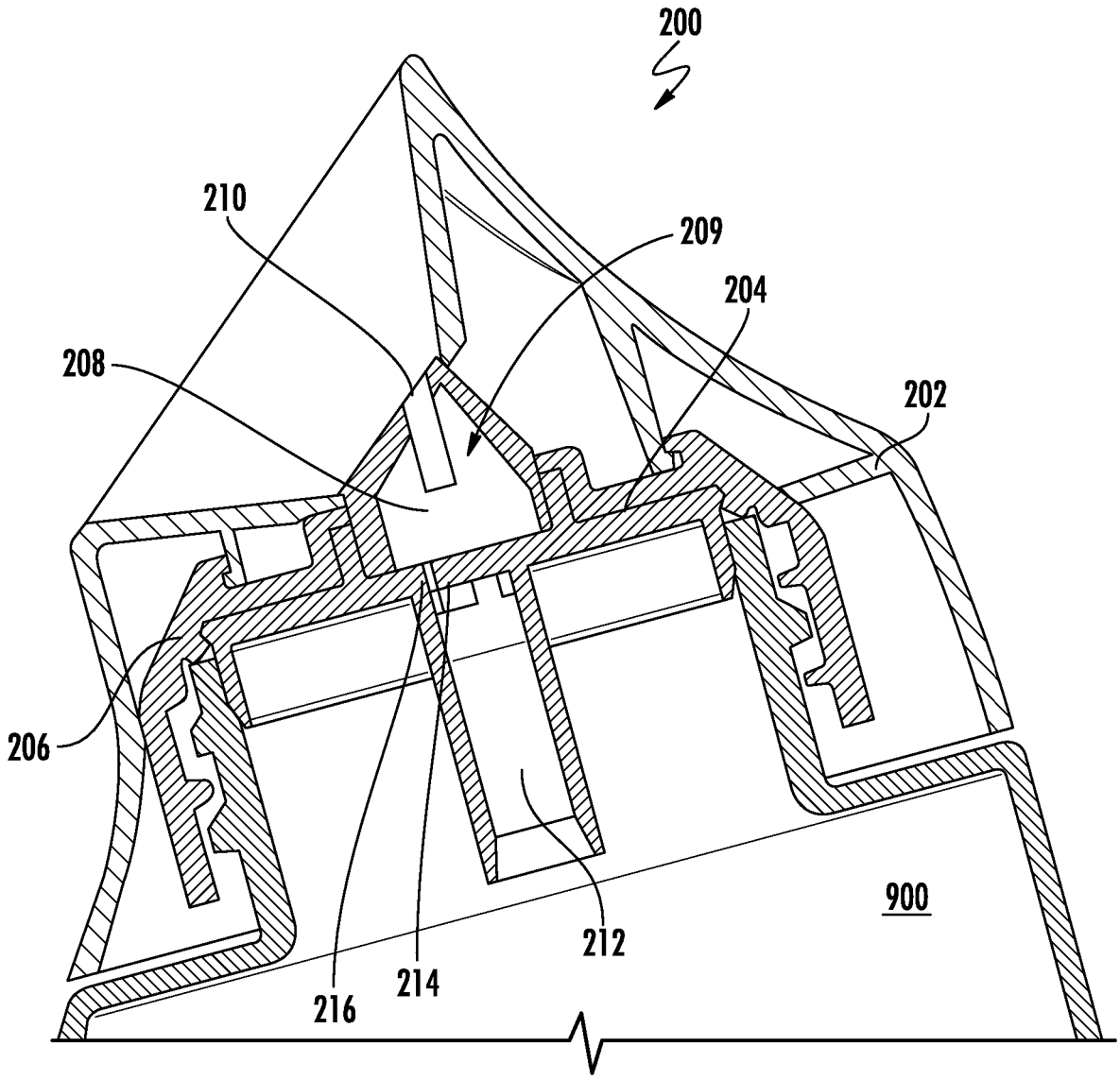
FIG. 8 illustrates a cross-section view of an atomizer according to various embodiments of the present invention.

A cross-sectional view of one embodiment of an atomizer 200 illustrated in FIGS. 6 and 7 is illustrated in FIG. 8. As illustrated, the atomizer 200 may include a plug seal 204, a closure 206, an exterior shell 202, and a chamber shell 208. The plug seal 204 may include a dip-tube connector 212, one or more air passageways 214, and one or more fluid passageways 216. A plug seal 204 may also include one or more seals extending away from a main platform of the plug seal 204 to form a seal with a surface of a bottle 900 opening when assembled to a bottle 900 as illustrated.

A chamber shell 208 may be snap-fitted or otherwise attached to the plug seal 204 above the one or more air passageways 214 and fluid passageways 216, creating a mixing chamber 209 between the chamber shell 208 and the plug seal 204. The chamber shell 208 may also include one or more orifice openings 210 in communication with the mixing chamber 209. An orifice opening 210 may allow product to pass from the mixing chamber 209 to atmosphere.

A closure 206 may attach and secure the plug seal 204 to an opening in a bottle 900. In some embodiments, a plug seal 204 may be attached to the closure 206 while in others the closure 206 may just hold the plug seal 204 in place. For example, as illustrated in FIG. 8, a plug seal 204 may include one or more lips or seal rings which may snap-fit into one or more grooves in the closure 206 in order to secure the plug seal 204 to the closure 206.

In some embodiments of the invention, a chamber shell 208 may also be attached to the closure 206 rather than to the plug seal 204.

An exterior shell 202 may be attached to the closure 206 as illustrated in FIG. 8. For example, the exterior shell 202 may include one or more lips or snap-fitment connections that may snap-fit or otherwise join with portions of the closure 206 or plug seal 204 or both. The exterior shell 202 may define the exterior aesthetics or look of the atomizer 200. In various embodiments, an exterior shell 202 may also include vent passageways and other features required for operation of the atomizer 200. As illustrated in FIG. 8, an opening in the exterior shell 202 may be configured to mate with the shape of one or more surfaces of the chamber shell 208 such that a portion of the chamber shell 208 is fitted in the opening of the exterior shell 202. The orifice opening 210 may be included in that portion of the chamber shell 208 extending into or visible through the opening in the exterior shell 202.

According to various embodiments of the invention, the exterior shell 202 may be customizable such that the closure 206, plug seal 204 and chamber shell 208 may be manufactured in mass and the exterior shell 202 changed to provide a custom aesthetic look for the atomizer 200. In this fashion, costs associated with manufacturing and assembling the atomizer 200 may be kept low by running most of the components in high-speed or high-cavitation molds while allowing for easy modification and customization by changing only the exterior shell 202.

While the atomizer 200 illustrated in FIG. 8 includes four components, other embodiments of the invention may include fewer components. For example, in some embodiments, the chamber shell 208 may be molded with the closure 206 such that one component is eliminated, further reducing costs associated with molding and assembling of an atomizer 200. In other embodiments, the plug seal 204 and closure 206 may be molded together to reduce part count and costs. In still other embodiments, the plug seal 204 and closure 206 may be molded together and the exterior shell 202 and chamber shell 208 may be molded together to further reduce the part count and the costs associated with manufacturing and assembling an atomizer 200 according to various embodiments of the invention.

According to some embodiments of the invention, an atomizer may include features to allow the atomizer to be turned on and off or adjusted from a closed to an open position wherein in the closed or off position a product may not be dispersed from the dispenser 100 and in the open or on position, product distribution is possible. In some embodiments of the invention, the on/off or open/closed toggling is accomplished with an atomizer 300 having a push/pull feature. In other embodiments of the invention, the on/off or open/closed toggling is accomplished with an atomizer 400 having a rotational feature. Other features may be incorporated with various embodiments of the invention to control the on/off or open/closed states of an atomizer as desired.

Figure 9:
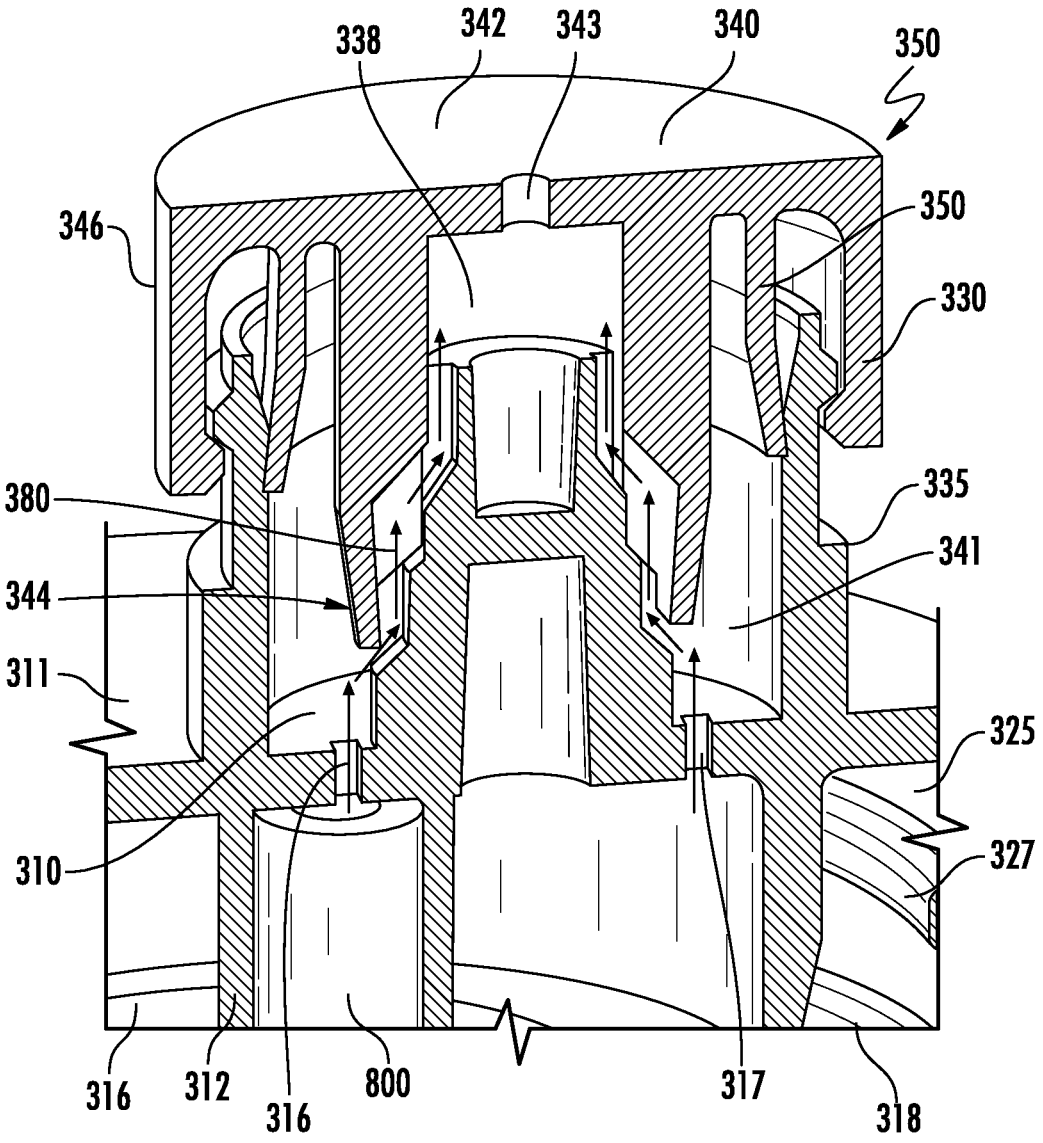
FIG. 9 illustrates a cross-section view of an atomizer according to various embodiments of the present invention.

An atomizer 300 having a push/pull toggle feature according to some embodiments of the invention is illustrated in FIG. 9. The atomizer 300 may be attached to a bottle 900 to facilitate evacuation of a product from the bottle 900 as a fog or spray. As illustrated, an atomizer 300 may include a closure 310 and a nozzle 340. In some embodiments of the invention, an atomizer 300 may also include an exterior shell (not shown) that functions with or independently of the nozzle 340 and provides aesthetics to the atomizer 300.

According to certain embodiments of the invention, the closure 310 of an atomizer 300 may include a primary wall 311 having a top surface and a bottom surface. A dip tube connector 312 may extend away from the bottom surface of the primary wall 311. The dip tube connector 312 may be circular in shape and may be configured to retain a dip tube 800 therein. One or more fluid openings 316 may extend through the primary wall 311, with one end of each of the one or more fluid openings 316 being on the bottom surface of the primary wall 311 and bounded by the dip tube connector 312 such that the one or more fluid openings 316 are in communication with an interior space formed by the dip tube connector 312. An example of a fluid opening 316 according to various embodiments of the invention is illustrated in FIG. 9.

The closure 310 may also include one or more seal rings 318 extending off of and away from the bottom surface of the primary wall 311 as illustrated in FIG. 9. The one or more seal rings 318 may mate with, fit against, or seal to an interior surface of an opening in a bottle 900 to create a fluid-tight seal (or relatively fluid-tight seal) between the seal rings 318 and the bottle 900.

A closure 310 may also include a closure skirt 325 extending off of the primary wall 311 to help retain the closure 310 on a bottle 900. The closure skirt 325 may include one or more features used to connect the closure 310 to a bottle 900. For example, as illustrated in FIG. 9, a closure skirt 325 may include one or more ramps 327 configured to mate with one or more closure ramps on a bottle 900 to allow the closure 310 to be screwed onto a bottle 900. In other embodiments of the invention, a closure skirt 325 may include other attachment features—such as a bayonet closure feature or snap-fit feature—that may be used to attach the atomizer 300 to a bottle 900.

A central post 330 may extend upwards from the primary wall 311 as illustrated in FIG. 9. The central post 330 may include an outer surface 332 and the outer surface 332 may have different shapes or configurations as required for the particular atomizer 300. For instance, as illustrated in FIG. 9, the central post 330 includes vertical surfaces that are perpendicular to the top surface of the primary wall 311 and angled surfaces extending therefrom.

An outer wall 335 may extend upwards from the primary wall 311 as illustrated in FIG. 9. The outer wall 335 circumscribes the central post 330. A space exists between the outer wall 335 and the central post 330. According to various embodiments of the invention, fluid openings 316 open or are in communication with the space formed between the outer wall 335 and the central post 330. In addition, one or more air holes 317 extending through the primary wall 311 may open up or be in communication with the space between the outer wall 335 and the central post 330 as illustrated in FIG. 9. While only one air hole 317 is viewable in FIG. 9, various embodiments of the invention may include two or more air holes 317 extending through the primary wall 311 and providing communication between an interior of a bottle 900 connected to the atomizer 300 and the space between the outer wall 335 and the central post 330.

An atomizer 300 according to various embodiments of the invention also includes a nozzle 340 as illustrated in FIG. 9. A nozzle 340 may include a nozzle face 342, an inner seal rib 344, an outer seal rib 350 circumscribing the inner seal rib 344, and an outer skirt 346 circumscribing the outer seal rib 350. Each of the inner seal rib 344, the outer seal rib 350, and outer skirt 346 may extend downward from the nozzle face 342. The nozzle 340 may be attached to the closure 310 such that an inner surface of the outer skirt 346 engages an outer surface of the outer wall 335 of the closure 310 as illustrated. The nozzle 340 may be pushed and pulled such that the bottom surface of the nozzle face 342 moves relative to the central post 330 of the closure 310. The embodiment illustrated in FIG. 9 is in an open or on position wherein the nozzle 340 is pulled outward from the closure 310 to allow fluid and gas exit through the orifice opening 343 in the nozzle face 342.

As illustrated, connection of the nozzle 340 to the closure 310 forms an interior chamber 341 between the nozzle 340 and the closure 310. The outer seal rib 350 of the nozzle 340 may seal against and contact an inner surface of the outer wall 335 of the closure 310, helping to define the interior chamber 341. The interior chamber 341 is open to or in communication with the one or more fluid openings 316 and one or more air holes 317. Fluid and air may pass freely into the interior chamber 341 through these openings and the contact between the outer seal rib 350 and the inner surface of the outer wall 335 prevents fluid from leaking from the atomizer 300.

A mixing chamber 338 is formed between a portion of the nozzle 340 circumscribed by the inner seal rib 344 and the central post 330. In an open or "on" state, the nozzle 340 is pulled away from the primary wall 311 of the closure 310, raising the position of the outer rib seal 350 relative to the outer wall 335 and expanding the volume of the interior chamber 341. At the same time, as the nozzle 340 is pulled away from the primary wall 311, the inner seal rib 344 disengages from contact with portions of the central post 330, exposing one or more flow channels 380 between the central post 330 and inner surface of the inner seal rib 344. The one or more flow channels 380 lead to the mixing chamber 338 where fluid and air are mixed before being expelled through the orifice opening 343 in the nozzle 340.

In a closed or "off" state, the nozzle 340 is pushed towards the primary wall 311 of the closure 310, resulting in an engagement of the inner seal rib 344 with an outer surface of the central post 330 such that fluid and air cannot pass from the interior chamber 341 into the mixing chamber 338. In this manner, the atomizer 300 may be turned "off" and leakage may be prevented because any fluid flowing into the interior chamber 341 is precluded from leaving the interior chamber 341 by the outer seal rib 350. The only place for fluid in the interior chamber 341 to go is to flow back into an interior of a bottle 900 attached to the atomizer 300.

According to various embodiments of the invention, an interior surface of the inner seal rib 344 may be configured to match the shape of the central post 330 to form a better seal. Flow channels 380 may be formed between the central post 330 and the inner seal rib 344 by changing the shape or creating channels in either or both of the respective parts.

A push/pull configuration of an atomizer 300 according to various embodiments of the invention may be turned on by pulling the nozzle 340 away from the closure 310 and may be turned off by pushing the nozzle 340 towards the closure 310. In addition, a twist feature may be added such that once pulled outwards, the nozzle 340 could be twisted into a locked position such that it will not be pushed back down towards the closure 310 without first rotating the nozzle 340 back to the original position. One or more posts on an exterior surface of the outer wall 335 may engage the outer skirt 346 of the nozzle 340 to prevent such movement as desired.

Figure 10:
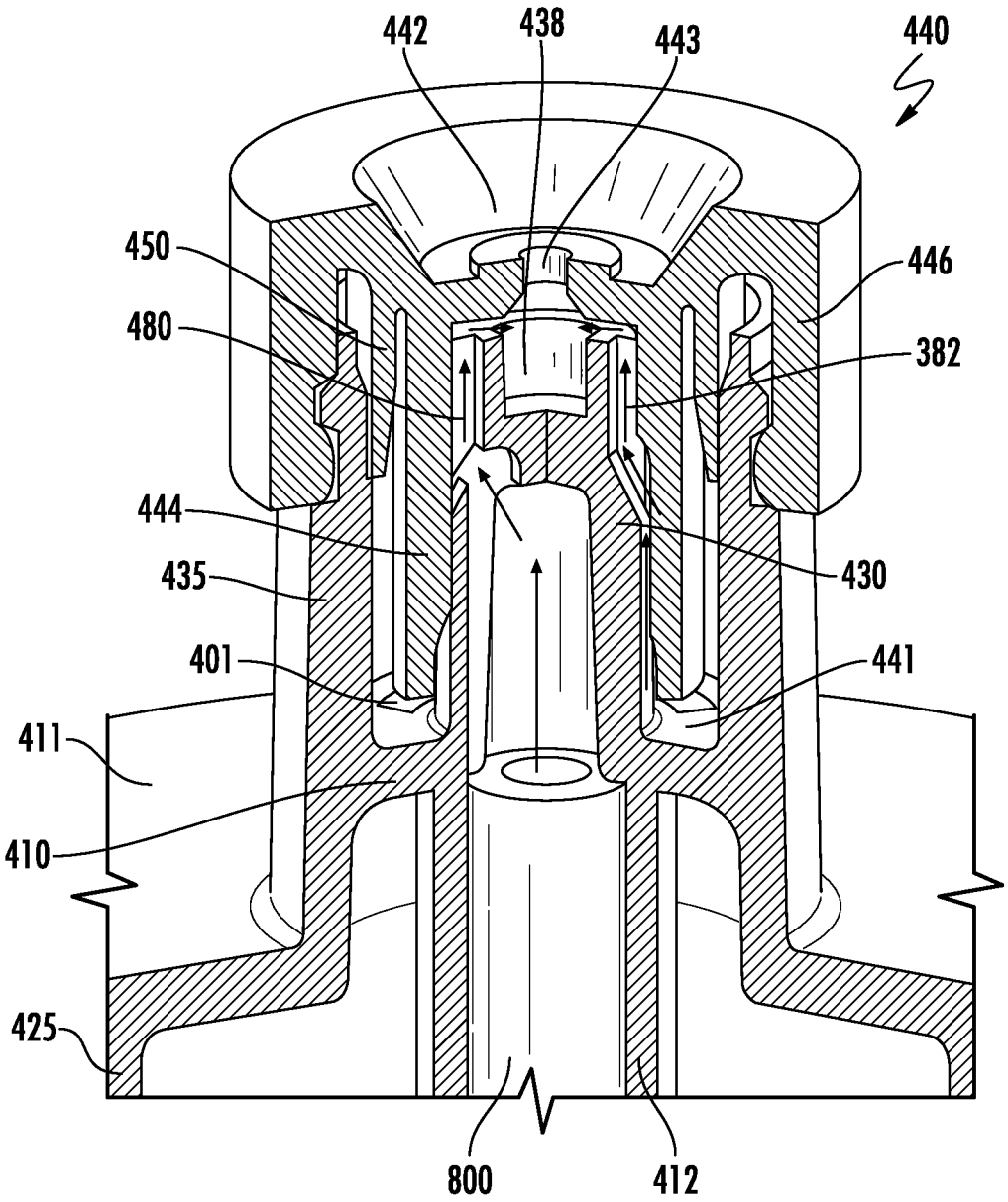
FIG. 10 illustrates a cross-section view of an atomizer according to various embodiments of the present invention.

An atomizer 400 for use with a dispenser 100 according to other embodiments of the invention is illustrated in FIG. 10. As illustrated, an atomizer 400 may include a closure 410 and a nozzle 440. According to such embodiments of the invention, the nozzle 440 may rotate about a portion of the closure 410 from an open or "on" position to a closed or "off" position. In an "on" position, product may be dispersed from the atomizer 400. In an "off" position, product may not be dispersed and the atomizer 400 prevents leakage of product, even if the dispenser 100 to which the atomizer 400 is attached is tipped-over or inverted.

According to various embodiments of the invention, an atomizer 400 closure 410 may include a primary wall 411 having a top surface and a bottom surface, the bottom surface configured to be adjacent a bottle 900 surface when the atomizer 400 is attached to a bottle 900. A closure skirt 425 may extend off of the primary wall 411 and may include closure features adapted to connect the atomizer 400 to a bottle 900. For instance, closure features as described with respect to other embodiments of the invention may be utilized, including threaded closure features, bayonet closure features, and snap-fit closure features. A dip tube connector 412 may also extend off of a bottom surface of the primary wall 411. In addition, in some embodiments of the invention, a dip tube connector 412 may extend off a secondary wall formed as part of the closure 410 but not necessarily as part of the primary wall 411 as illustrated in FIG. 10. A central post 430 may extend away from a top surface of the primary wall 411 or away from the secondary wall in a direction opposite of the dip tube connector 412 as illustrated in FIG. 10. A portion of the central post 430 may be hollow as illustrated, forming—in conjunction with a dip tube 800 retained by the dip tube connector 412—an interior fluid chamber. An outer wall 435 may extend upwards from a top surface of the primary wall 411 and may circumscribe the central post 430 as illustrated.

A nozzle 440 of an atomizer 400 may include a nozzle face 443 having an orifice opening 443 passing through the nozzle face 443. An inner seal rib 444 may extend off of a bottom—or interior—surface of the nozzle 440, circumscribing the orifice opening 443. An outer seal rib 450 may extend off of a bottom—or interior—surface of the nozzle 440, circumscribing the inner seal rib 444. An outer skirt 446 circumscribes both the inner seal rib 444 and the outer seal rib 450 as illustrated in FIG. 10.

According to various embodiments of the invention, a nozzle 440 fits onto the closure 410 such that the inner seal rib 444 sits adjacent the central post 430, circumscribing the central post 430 and coming into sealing contact with the central post 430 in certain configurations. The outer seal rib 450 contacts an inner surface of the outer wall 435 of the closure 410 in sealing engagement and is moveable against the inner surface of the outer wall 435. Fitment of the nozzle 440 on the closure 410 defines an interior chamber 441 in the atomizer 400. In addition, a mixing chamber 438 is defined between a bottom surface of the nozzle face 442 and the top of the central post 430 as illustrated in FIG. 10.

The nozzle 440 may attach to the closure 410 by engagement of the outer skirt 446 of the nozzle 440 with the outer wall 435 of the closure 410. The nozzle 440 is attached to the closure 410 such that the nozzle 440 may be rotated relative to the closure 410 to turn the atomizer 400 on and off. In some embodiments, the nozzle 440 and the closure 410 may include corresponding ramps or other features to allow movement of the nozzle 440 up and down relative to the closure 410 to open and close the atomizer 400. In other embodiments, rotation of the nozzle 440 may move the nozzle 440 and corresponding openings in the nozzle 440 and closure 410 so that they align or do not align to form pathways through the atomizer 400. For example, as illustrated in FIG. 10, a central post 430 may include a fluid flow channel 480 in a portion of the central post 430 abutting a portion of the inner seal rib 444. An opening in the lower surface of the nozzle face 442 may be rotated to coincide with the fluid flow channel 480 such that fluid may pass through the fluid flow channel 480 and into the mixing chamber 438 as illustrated. When the nozzle 440 is rotated, the opening in the lower surface of the nozzle face 442 may be realigned such that it is not in communication with the fluid flow channel 480 such that the lower surface of the nozzle face 442 shuts off or prevents flow of fluid through the fluid flow channel 480.

Similarly, portion of a bottom or lower surface of the nozzle face 442 may include grooves or openings that aligned with air flow channels 382 when the nozzle 440 is in an "on" or open position as illustrated in FIG. 10. In the "on" or open position, air may flow through one or more air flow passageways 401 in the closure 410 and into the one or more air flow channels 382. When nozzle 440 is rotated to an "off" or closed position, portions of the bottom or lower surface of the nozzle face 442 may seal against or close off the air flow channels 382 in the atomizer 400, preventing the flow of air through the air flow channels 382.

When an atomizer 400 is in an "off" or closed position, the nozzle 440 prevents flow of any fluid, product, or air from the bottle 900 through the atomizer 400. When rotated to an "on" or open position, the nozzle 440 and closure 410 are aligned such that fluid may pass through one or more fluid flow channels 480 and air may pass through one or more air flow channels 382. Fluid and air passing through the respective channels may be mixed in the mixing chamber 438 and forced out of the orifice opening 443 as a fog or spray of product.

Figure 11:
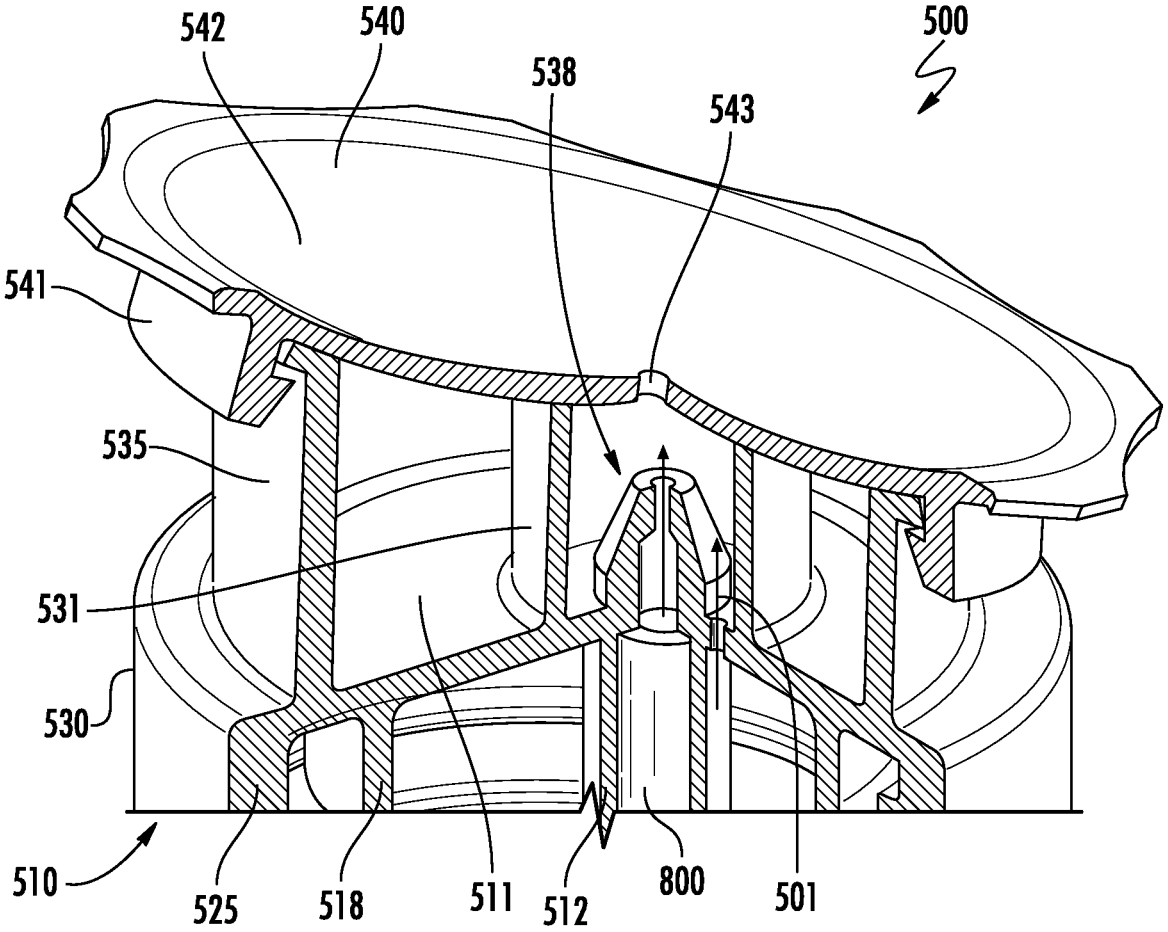
FIG. 11 illustrates a cross-section view of an atomizer according to various embodiments of the present invention.
Figure 12:
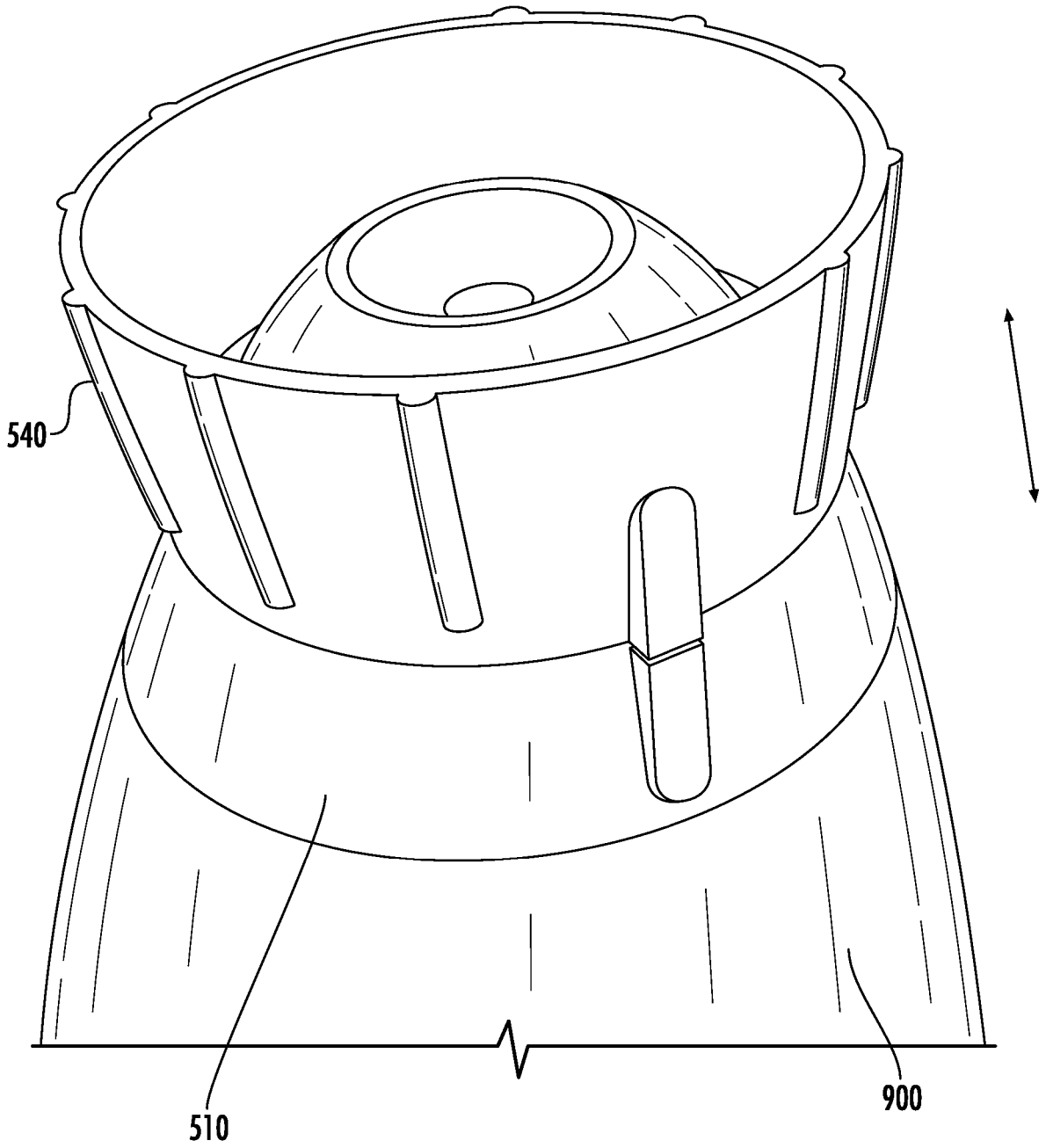
FIG. 12 illustrates an atomizer according to various embodiments of the invention.

An atomizer 500 according to still other embodiments of the invention is illustrated in FIGS. 11 and 12. As illustrated, an atomizer 500 may include a closure 510 and a nozzle 540. The closure 510 may include a primary wall 511 having a closure skirt 525, a seal ring 518, and a dip tube connector 512 extending off of a bottom surface of the primary wall 511 as illustrated in FIG. 11. A central post 530 and outer wall 535 may extend off of a top surface of the primary wall 511. A closure spout 531 circumscribed by the central post 530 may define a flow path through the primary wall 511 and into a mixing chamber 538. The closure spout 531 may be in communication with an interior of the dip tube connector 512. One or more air holes 501 may also project through the primary wall 511 into the mixing chamber 538.

A nozzle 540 may be connected to or mated with the closure 510 in such a way that the nozzle 540 may be rotated to move the atomizer 500 into an "on" or open position in which a product may be dispensed and into an "off" or closed position in which product is not and cannot be dispensed. A nozzle 540 may include an orifice opening 543 through a nozzle face 542. A nozzle wall 541 may extend off of a bottom surface of the nozzle face 542. As illustrated in FIG. 11, a nozzle wall 541 may include one or more connection features corresponding to one or more similar features on the outer wall 535 of the closure 510, whereby such connection features moveably retain a connection between the nozzle 540 and the closure 510. As illustrated, the nozzle 540 may include a snap feature that can be snapped over a corresponding snap feature on the outer wall 535 to retain the nozzle 540 on the closure 510.

Attachment of the nozzle 540 to the closure 510 creates a mixing chamber 538 defined by an interior of the central post 530, a portion of the primary wall 511, and a bottom surface of the nozzle face 542. In an "on" or open position, the orifice opening 543 may be aligned with the mixing chamber 538 to allow product—fluid and air—in the mixing chamber 538 to escape through the orifice opening 543. In an "off" or closed position, the nozzle 540 is rotated such that the orifice opening 543 is no longer in communication with the mixing chamber 538, such that the mixing chamber 538 is sealed and product and air can only drain back into a bottle 900 connected to the atomizer 500.

In some embodiments of the invention, an atomizer 500 may include one or more stop features incorporated on the closure 510, the nozzle 540, or both to facilitate selection of "on" and "off" positions of the atomizer 500. For example, an atomizer 500 according to certain embodiments of the invention is illustrated in FIG. 12. As illustrated, the nozzle 540 may include alignment markings that correspond to alignment markings on the closure 510 which indicate whether or not the nozzle 540 is in an "on" or "off" position. The alignment markings may coincide with stops on the outer wall 535 of the closure 510 which prevent the nozzle 540 from being rotated past the alignment marking. In addition, such stops may include a tactile or audible feature to alert a user to the state at which the nozzle 540 is aligned. For example, when the nozzle 540 is rotated into an "on" or "off" position there may be a "click" or snap noise corresponding to a snap feature that secures the nozzle 540 in the desired position. To move the nozzle 540 out of such position, an increased force or torque may be required to begin movement of the nozzle 540. A second snap position may indicate that the nozzle 540 has been rotated into the opposite position.

Figure 13:
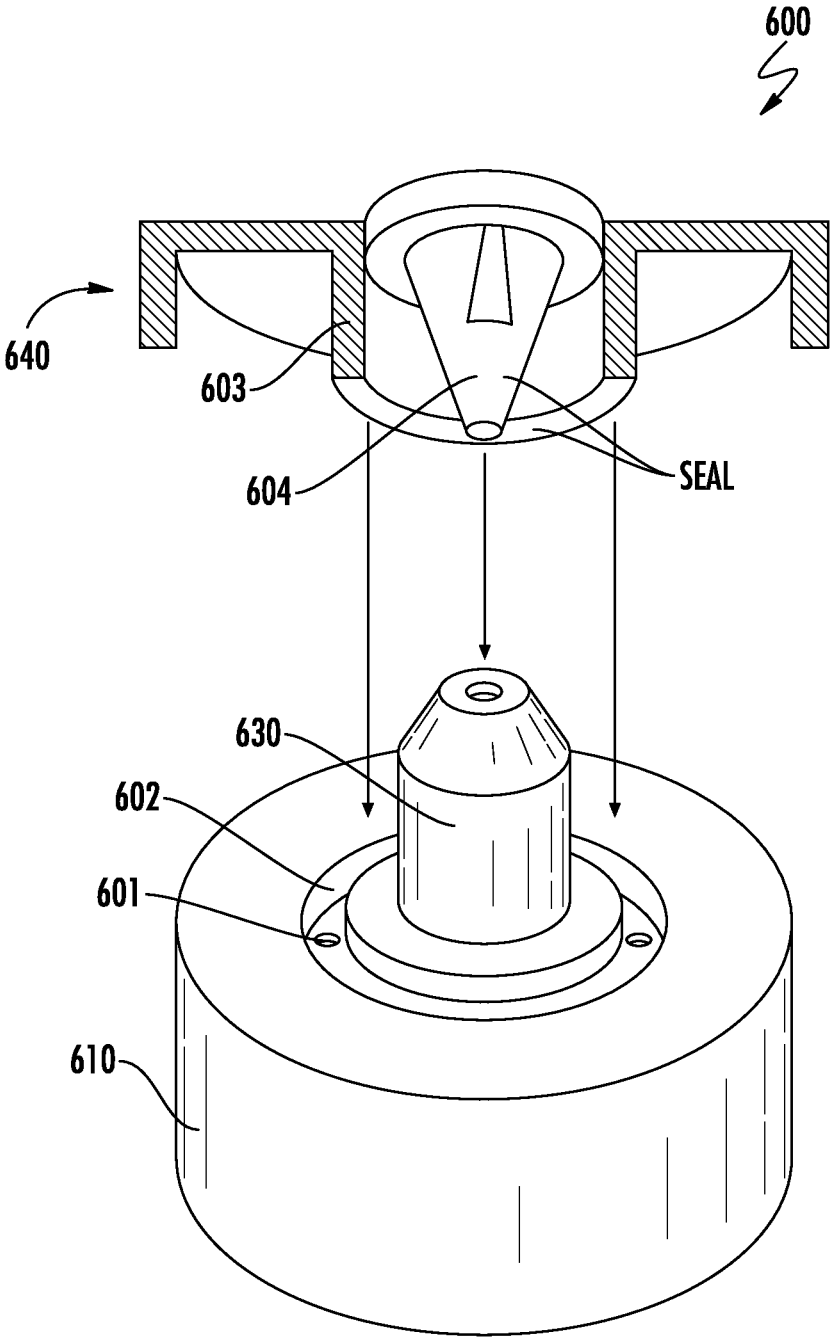
FIG. 13 illustrates an atomizer according to various embodiments of the invention.

An atomizer 600 according to other embodiments of the invention is illustrated in FIG. 13. An atomizer 600 may include a closure 610 having a central post 630 and a well 602 sunken relative to the central post 630. One or more air holes 601 may be positioned in the well 602. A corresponding nozzle 640 may include an outer seal feature 603 configured to sit in the well 602 and to seal off the one or more air holes 601 in an "off" position. An inner seal 604 may seal a flow channel in the central post 630 in an "off" position. When the nozzle 640 is pulled away from the closure 610, the outer seal feature 603 allows air to flow through the air holes 601 and the inner seal 604 allows product to flow through the central post 630 and into a mixing chamber before being expelled through one or more holes or an orifice in the nozzle 640.

Figure 14:
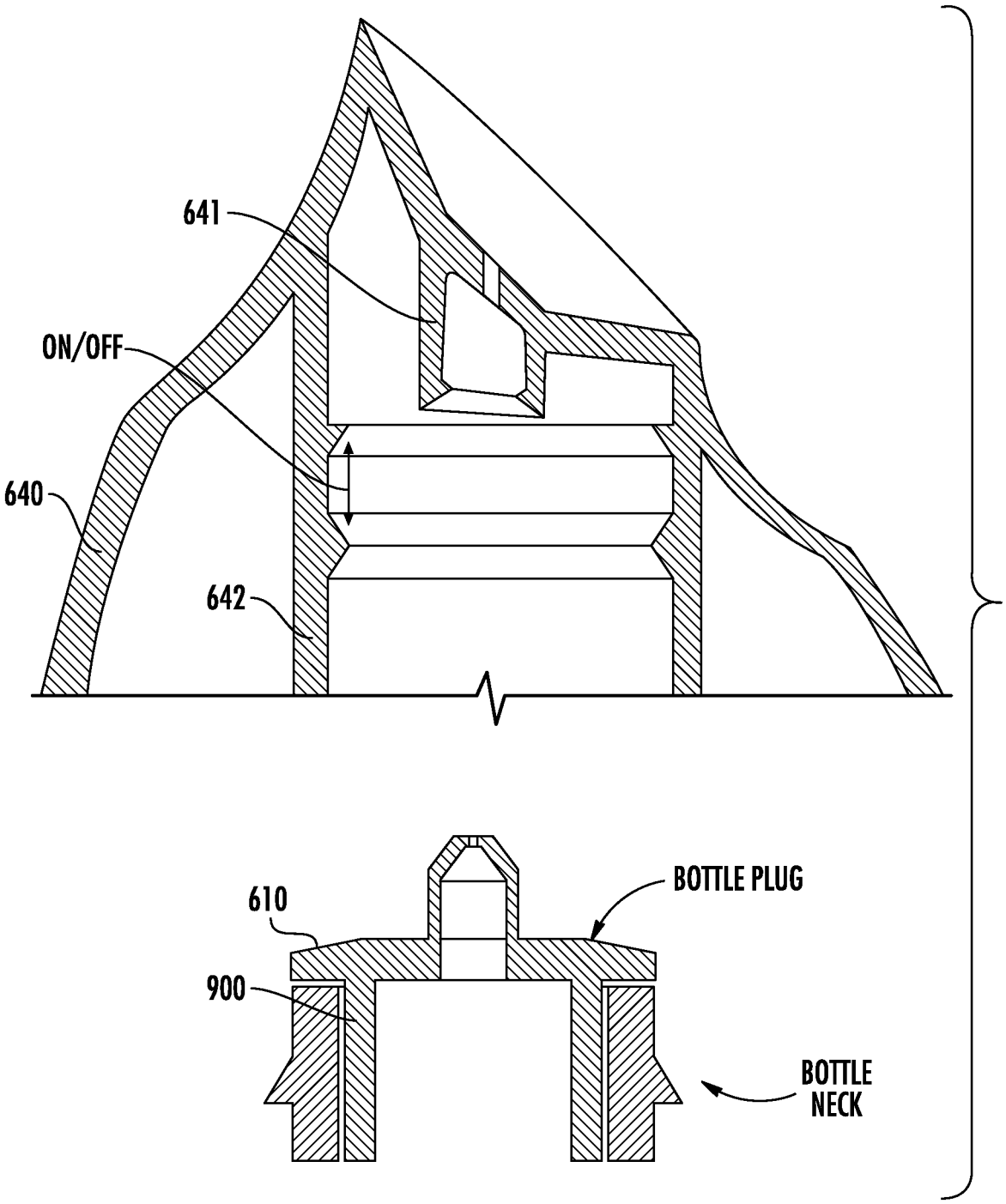
FIG. 14 illustrates an atomizer according to various embodiments of the invention.

An atomizer 600 according to other embodiments of the invention is illustrated in FIG. 14. The atomizer 600 may include a bottle plug 610 which may be seated in an opening in a bottle 900 as illustrated. The bottle plug 610 may include a central post 630 defining a fluid flow channel from an interior of the bottle 900 to an exterior of the bottle plug 610. A cap 640 having an inner wall 641 and an outer wall 642 may be seated over the bottle plug 610 such that the central post 630 fits into a chamber defined by the inner wall 641 and the outer wall 642 attaches to the bottle 900. Movement of the cap 640—either by a push/pull mechanism or a turning mechanism—may seal the fluid flow channel defined by the central post 630 against a surface of the chamber in an "off" position and open the channel in an "on" position such that fluid and air may mix in the chamber and be expelled through an orifice opening in the cap 640. In an alternate embodiment, an orifice opening may be off-centered relative to the fluid flow channel such that when the cap 640 is moved to an "off" position, the orifice opening is sealed against a surface of the central post 630 preventing product from escaping the chamber and when the cap 640 is moved to an "on" position, the orifice opening is not closed or sealed, allowing product to escape through the orifice opening.

Figure 15:
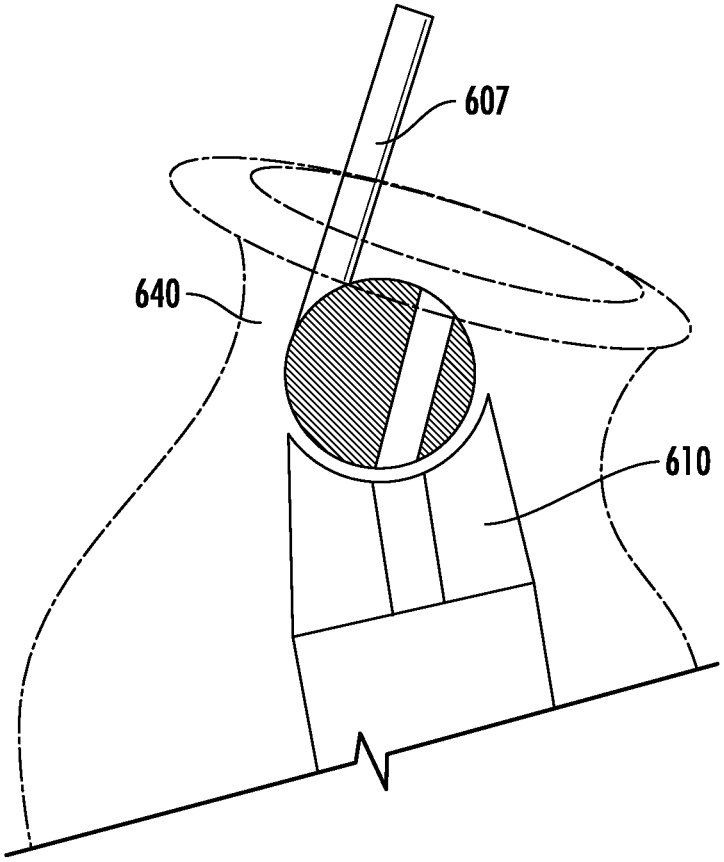
FIG. 15 illustrates an atomizer according to various embodiments of the invention.

An atomizer 600 according to still other embodiments of the invention is illustrated in FIG. 15. As illustrated, an atomizer 600 may include a closure 610, a cap 640, and a spouted closure 607. The closure 610 and cap 640 may be connected to a bottle 900. The closure 610 may include one or more fluid paths and one or more air paths passing through the closure 610. The spouted closure 607 may include a ball joint with a flow path that may be aligned with the one or more fluid paths and one or more air paths in the closure 610 to allow a product to flow therethrough. Movement of the spouted closure 607 may misalign the spouted closure 607 flow path from the fluid paths and air paths in an "off" position, preventing disbursement of a product through the atomizer 600. The spouted closure 607 may also be rotated to put the atomizer 600 in an "on" position where the spouted closure 607 flow path is aligned with the fluid paths and air paths in the closure 610 to allow disbursement of a product from a bottle 900.

According to some embodiments of the invention, a bottle 900 may improve the functional aspects of a dispenser 100. The bottle 900 illustrated in FIGS. 1 through 7 include a shape or configuration having a hand ledge 950 centrally located along the bottle 900. The hand ledge 950 may be configured to fit a user's hand and to assist with the holding of the bottle 900 in a comfortable and natural position. In addition, the location of the hand ledge 950 may be critical. According to certain embodiments of the invention, the position of the hand ledge 950 is below the top third of the bottle 900. In other embodiments it is positioned within the middle third of the bottle 900. The position of the hand ledge 950 effectively lowers a user's grasp on the bottle 900, which has been found to facilitate better evacuation of the bottle 900 during use. For example, many prior art devices utilizing aspirators and bottles include a bulb positioned in the top portion of a bottle such that when a user grasps the bottle their hand is drawn to the top third of the bottle. Squeezing the bottle from this position is not ideal for evacuating the bottle. Thus, inclusion of a hand ledge 950 lower on the bottle 900 surface encourages the proper use of the bottle 900 and atomizer combination such that better evacuation may be accomplished.

In other embodiments of the invention, the positioning of a bottle curve 952 may be critical to operation of the atomizer and the regulation of force to actuate and recovery of a bottle 900. For example, providing a bottle curve 952 above the hand ledge 950 that has a rounded configuration is believed to reduce the force to actuate and improve the recovery of the bottle 900. In addition, having a general bottle 900 cross-sectional shape that is substantially oval at the bottle curve 952 or in the middle of the hand ledge 950 area is believed to improve the force to actuate and the recovery of the bottle 900 following actuation of the bottle 900 and atomizer.

While various embodiments of the invention include different closure and nozzle features, it is understood that the particular combinations of such features are not limited. Various embodiments of the invention may utilize closure and nozzle features that are describe with respect to other embodiments of the invention.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A dispenser, comprising:

an atomizer, comprising a closure and a nozzle;

said closure comprising:

a primary wall;

a closure skirt extending off a bottom surface of the primary wall;

at least one fluid opening in the primary wall;

a dip tube connector extending off the bottom surface of the primary wall and circumscribing the at least one fluid opening;

a central post extending off a top surface of the primary wall, the central post having a fluid flow opening extending therethrough;

an outer wall extending off the top surface of the primary wall and circumscribing the central post; and at least one air hole extending through the primary wall between the central post and the outer wall;

a nozzle, comprising:

a nozzle face;

an orifice opening in the nozzle face;

an inner seal rib extending off a bottom surface of the nozzle face and circumscribing the orifice opening, said inner seal rib at least partially engaging said central post and defining an air flow channel between an outer surface of said central post and an inner surface of said inner seal rib;

an outer seal rib extending off the bottom surface of the nozzle face and circumscribing the inner seal rib, said outer seal rib engaging an inner surface of said outer wall; and an outer skirt extending off the nozzle face and circumscribing the outer seal rib and engaging an outer surface of said outer wall, said inner sealing rib having a bottom edge at least partially engaging the top surface of the primary wall, said nozzle being rotatable relative to the closure to be moved from an on position wherein said bottom edge of said inner sealing rib is not blocking said air hole through said primary wall to a closed position wherein said bottom edge of said inner sealing rib blocks said air hole; and a squeezable bottle, comprising a substantially oval, inwardly contoured hand ledge.

2. The dispenser of claim 1, wherein the hand ledge is positioned in a middle third of the bottle.

3. The dispenser of claim 1 wherein a mixing chamber is formed between the central post of the closure and the bottom surface of the nozzle.

4. The dispenser of claim 3 wherein an interior chamber is formed between the central post of the closure and the outer wall of the closure.

5. The dispenser of claim 1 wherein an interior chamber is formed between the central post of the closure and the outer wall of the closure.

* * * * *